United States Patent [19]

Oram

[11] Patent Number: 4,519,021

[45] Date of Patent: May 21, 1985

[54] OPERATING THEATRE TABLE LIGHT

[76] Inventor: John A. Oram, 243 Heath Rd., Leighton Buzzard, Bedfordshire, England

[21] Appl. No.: 633,997

[22] Filed: Jul. 24, 1984

Related U.S. Application Data

[62] Division of Ser. No. 488,879, Apr. 26, 1983.

[30] Foreign Application Priority Data

Apr. 28, 1982 [EP] European Pat. Off. ..... 82 302194.4

[51] Int. Cl.[3] ..... F21V 9/00

[52] U.S. Cl. ..... 362/277; 362/33; 362/230; 362/232; 362/250; 362/285; 362/286; 362/293; 362/308; 362/309; 362/319; 362/372; 362/418; 362/449; 362/455; 362/804

[58] Field of Search ..... 362/33, 230, 232, 250, 362/277, 285, 286, 293, 308, 309, 319, 372, 418, 449, 455, 804

[56] References Cited

U.S. PATENT DOCUMENTS 4,462,067 7/1984 Altman ..... 362/285

*Primary Examiner*—Stephen J. Lechert, Jr.

*Attorney, Agent, or Firm*—Sughrue, Mion, Zinn, Macpeak and Seas

[57] ABSTRACT

The light comprises a cluster of lamp unts (100), pivotally mounted at (6,7), on respective chassis (8) running on a loop track. The lamp units are approximately equidistant from a central axis and illuminate a common patch on the axis. Each chassis (8) is connected to a respective chain (35) which may be driven to move individual chassis (8) along the track, changing the configuration of the cluster. A linkage (26,27,31) enables the lamp unit inclination to be varied and a linkage (12,13,14,16, 18) enables the relative positions of a bulb (1) and a concave reflector (10) to vary, thereby varying the beam width. The rollers (18) of each unit roll on a surface of a first common hoop and the rollers (31) on a surface of a second common hoop. The hoops are movable enabling the inclination of beamwidth of all the lamp units to be varied simultaneously, changing the patch range or size.

10 Claims, 6 Drawing Figures

OPERATING THEATRE TABLE LIGHT

Figure 1:
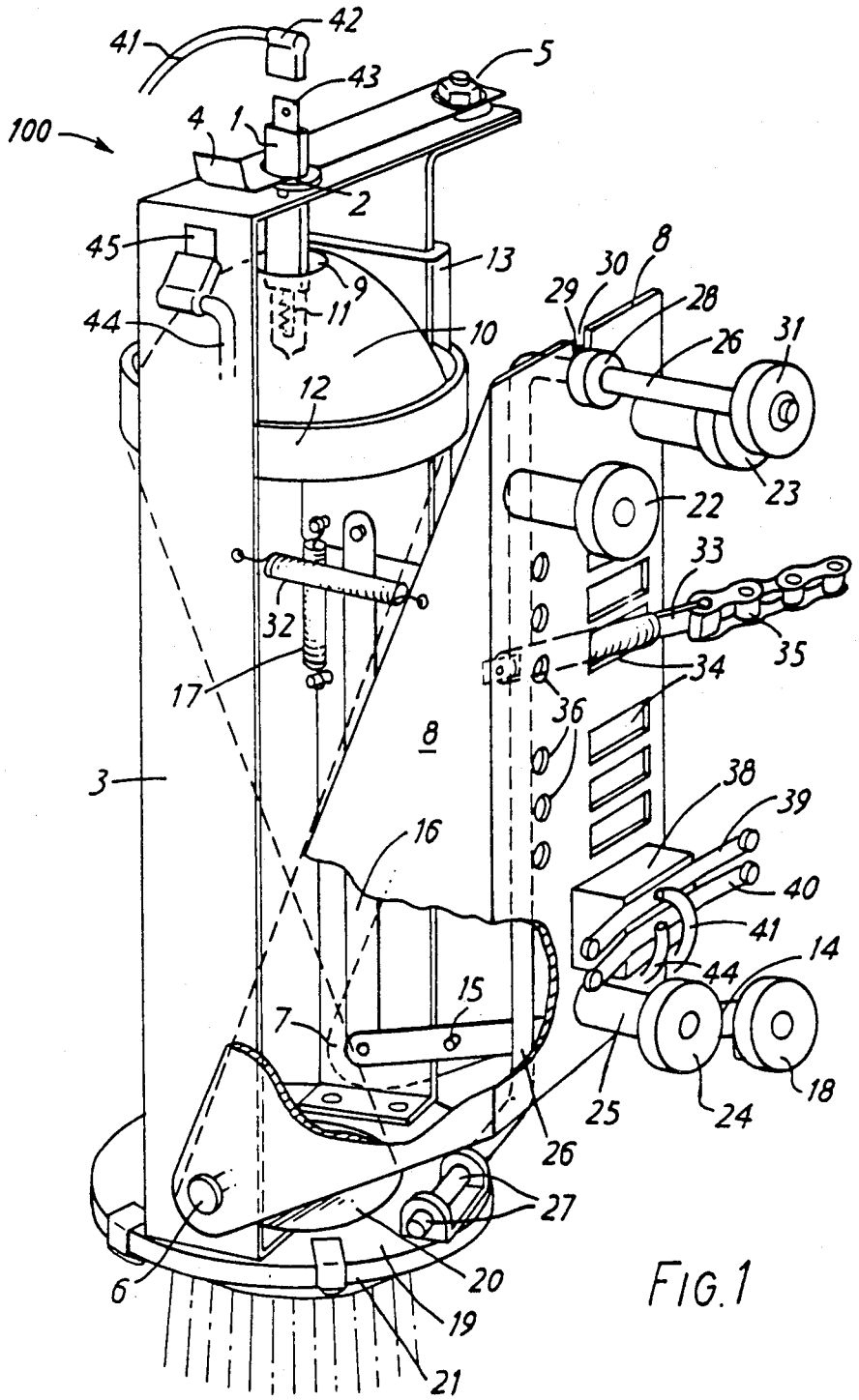

This is a division of application Ser. No. 488,879, filed Apr. 26, 1983, pending.

The present invention relates to an operating theatre table light comprising a cluster of lamp units at least approximately equidistant from a central axis of the light and (in use) illuminating a common patch on the said axis.

During an operation surgeons normally adhere to their preferred positions round the table although these positions vary from team to team. Lighting is usually provided from above by a light of the type to which this invention relates, the cluster being positioned before the operation so as to provide optimum illumination having regard to the positions of the operating team. It is often not possible to position the light so that the output of all the units of the cluster falls on the wound. The illumination may be improved by providing one or more satellite lamps (see for instance U.S. Pat. No. 3,240,925 and FR No. 111 2253) mounted on arms to be independently movable about the principal cluster. However, the satellite lamps are radially outside the lamp units of the principle cluster and the light therefrom is too obliquely directed to give effective illumination of the wound.

During an operation involving a deep wound it is difficult to position the cluster to illuminate the bottom of the wound without the heads and shoulders of the surgeons blocking much of the light, while the angle of the light from the satellite units prevents them illuminating the wound bottom. The problem of poor illumination is particularly bad during gynaecological operations and knee operations, during which the surgeon sits at the end of the table, with the cluster positioned approximately horizontally behind him. Despite known methods of filtering out the infra-red component of the light, using dichroic mirrors or filters, heating of the surgeons head and shoulders causes discomfort, particularly during long operations.

It is an object of the present invention to overcome these problems, so as to decrease the amount of light which is wasted, and the discomfort of the surgeons.

Apparatus according to the present invention is characterised in that at least some of the lamp units of the cluster are individually movable about the central axis, so that the principle cluster may be arranged in a variety of configurations. The configuration is chosen before the operation begins, to minimise the amount of light from the principle cluster which is blocked by personnel. The illumination of the bottom of deep wounds, for instance, is thereby improved, because extra light is provided by the principle cluster, at an angle of incidence which allows it to penetrate deep into the wound. The light beams produced by lamp units of the cluster are generally arranged to converge to form a patch where the combined beam has minimum cross-section and maximum illumination. The distance from the cluster to the patch will be referred to as the patch range and it will be appreciated that this range is determined by the mutual convergence of the beams. It is a further object of the invention to provide an operating theatre table light with an adjustable patch range so that the patch can be arranged to be at the wound regardless of the distance of the light from the wound.

The size of the wound varies according to the operation being performed. Accordingly, it is a further object of the invention to provide a light with a patch of variable size.

The need to reduce the likelihood of infection of the wound has led to the use of a flow of sterile air downward onto the wound and then outward into the threatre. It is particularly important that this flow is not interrupted in the region of the wound, because air turbulence can transfer infection from non-sterile objects to the wound. The principle cluster of the apparatus of the invention may be mounted in a toroidal housing thereby allowing a flow of air directly downward, through the central aperture, onto the wound. The flow is little disturbed by the cluster. The toroidal housing may have a streamline section, to allow flow around the housing to reform with a minimum of turbulence.

Figure 3:
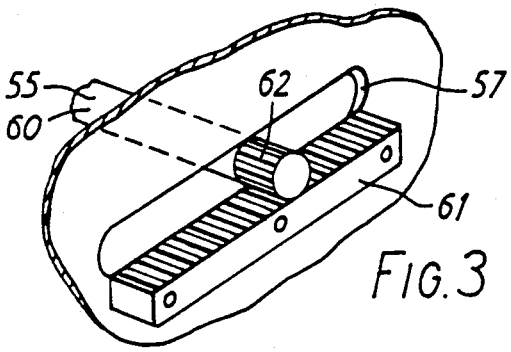
Figure 2:
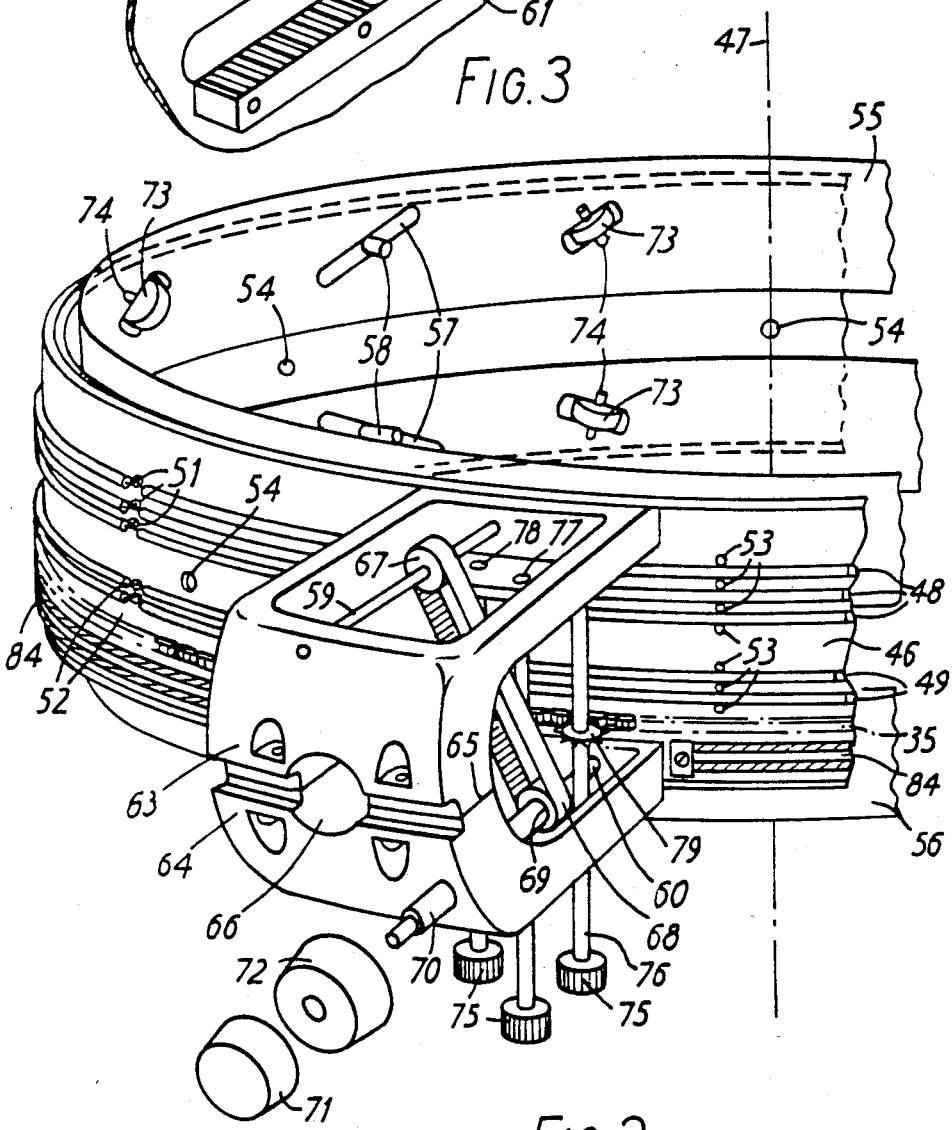
Figure 4:
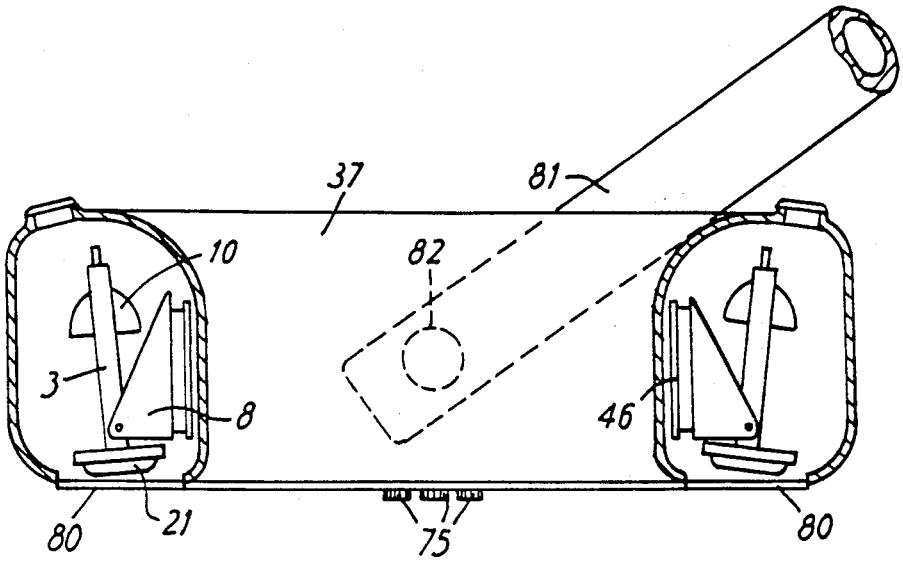
Figure 5:
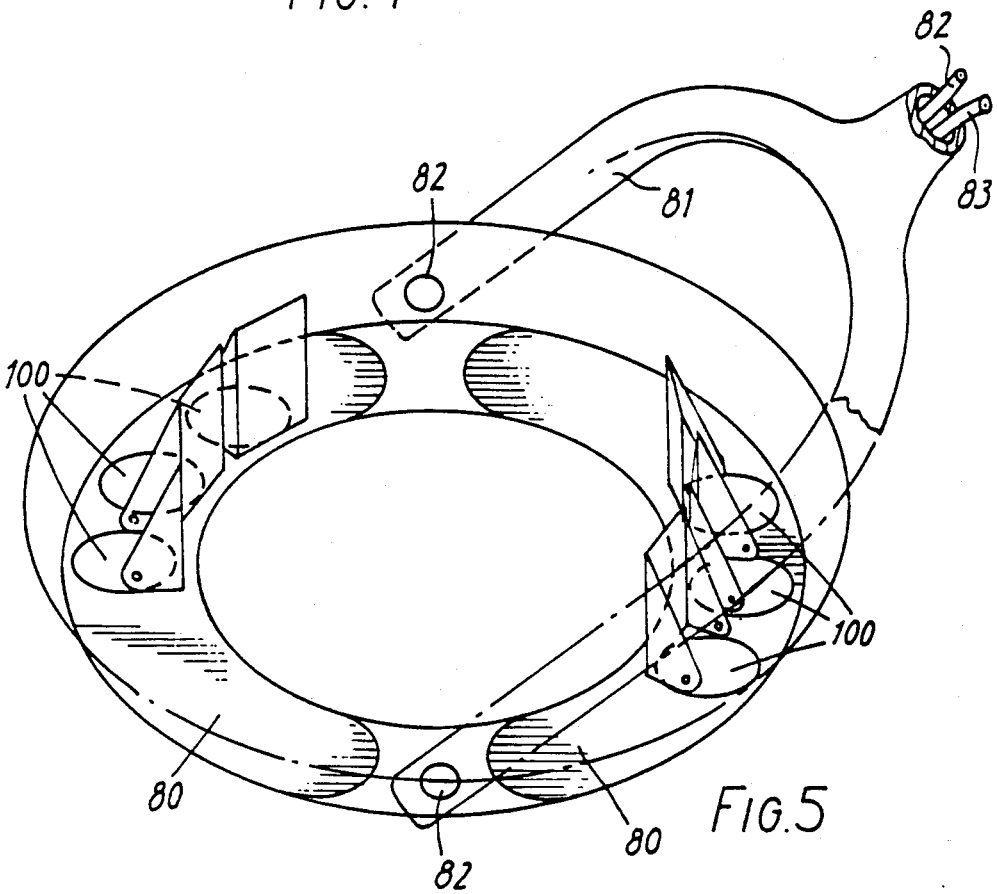
Figure 6:
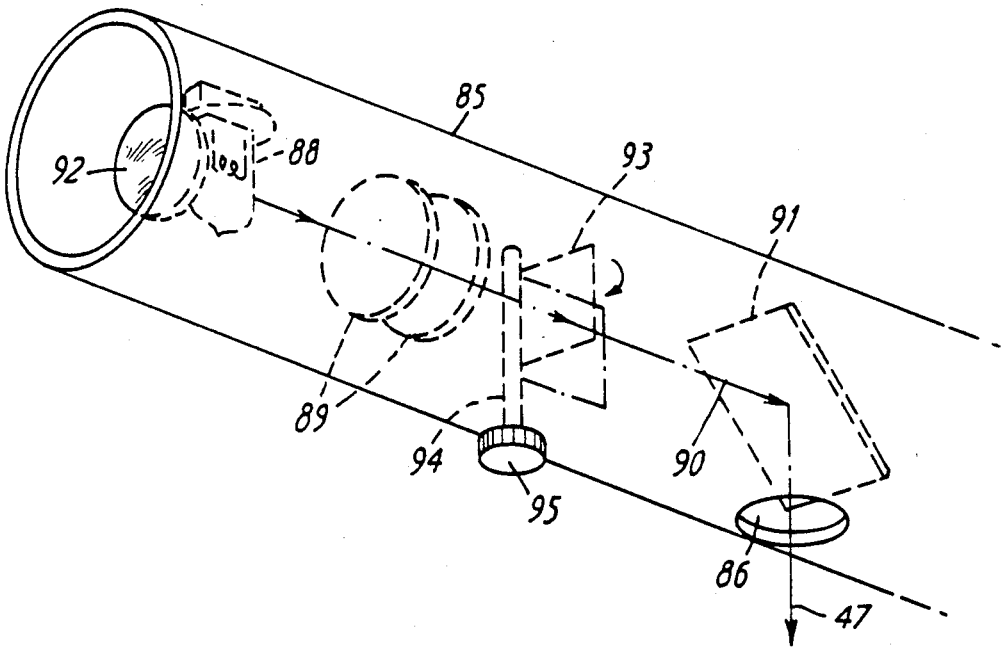

One exemplary embodiment of the invention will now be described with reference to the accompanying drawings in which:

FIG. 1 is a perspective view, partially cut away, of one lamp unit of the light, FIG. 2 is a perspective view of part of the structure for supporting the lamp units, FIG. 3 shows a detail of the apparatus of FIG. 2, FIG. 4 is a partly schematic sectional view of the complete light, looking along the axis of the gymbal mounting, FIG. 5 is a schematic perspective view of the complete light, and FIG. 6 is a schematic diagram of apparatus facilitating positioning of the light.

The lamp unit 100 of FIG. 1, comprises a frame 3 pivotally mounted at 6 and 7 on a chassis 8. A bulb 1, preferably a quartz halogen bulb, is located in a hole 2 in the frame 3. The hole 2 is notched to ensure correct alignment of the bulb 1. A latch 4 retains the bulb 1 in position and can swing away on its mounting 5 to permit bulb replacement.

The bulb 1 projects through a hole 9 in a reflector 10 so that its filament 11 lies on the axis of the reflector 10. The reflector 10 is supported by a ring 12 which is integral with a slider 13 slidably mounted on one limb of the frame 3 to permit the relative position of the filament 11 along the axis of the reflector to be varied. The position of the slider 13 is changed by a lever 14 pivoted at 15, and coupled to the slider 13 by a link 16. A spring 17 acts between the frame 3 and the slider 13 to urge the slider in a downward direction. At its second end, the lever 14 is cranked and carries a roller 18 with a V section circumferential groove.

The reflector 10 is approximately elliptical when sectioned through its axis, and is preferably dichroic coated to reduce the heat reflected and to control the colour temperature of the light output of the unit. Ellipsoidal reflectors are known as a means of obtaining a converging beam of light. The convergence point and the convergence angle of the rays depend on the relative positions of the reflector and the filament. The apparatus is arranged so that the convergence point always lies between the reflector 10 and an aperture ring 19 mounted on the bottom of the frame 3. To the underside of the aperture ring 19 is clipped a dichroic coated heat filter glass 20 which has a slightly diffusive surface and below this, a converging lens 21, preferably a fresnel lens. Because the convergence point of the beam is between the reflector 10 and the aperture ring 19, the emergent beam is divergent. The divergence and thus the size of the light patch at a given range is varied by movement of the lever 14.

The chassis 8 carries two rollers 22 and 23 set as widely apart as possible and forming with a third roller 24 the corners of an equilateral triangle. The rollers 22, 23, 24 all have V section circumferential grooves. The roller 24 rotates on a pivot 25 which has an adjustable pivot axis. A rigid link 26 is pivotally attached at 27 to the aperture ring 19 so as to be parallel with the axis of the pivots 6 and 7. Above the level of the rollers 22, 23, the link 26 turns through a right angle and has an upper horizontal section which carries two collars 28 and 29, allowing the link 26 to slide vertically, but without shake in a slot 30 in the chassis 8. At its upper extremity the link 26 carries a roller 31 having a V section circumferential groove. A spring 32 urges the tilting frame 3 towards the chassis 8 and thus the V roller 31 is urged downwards.

A hook 33 is spring mounted on the chassis 8 to project through a rectangular aperture 34 in the chassis 8 and to engage the terminal link of a roller chain 35, whose function will be described below. The other end of the chain 35 (not shown in FIG. 1) is bolted to the chassis 8 through a hole 36. The chassis 8 has six rectangular apertures 34 and corresponding holes 36, so that six identical lamp units 100 can be connected to respective roller chain bands. The bands are used to change the configuration of the cluster lamp units.

Electrical connection to the lamp units is provided through two double ended spring brushes 39 and 40, mounted on the chassis 8 by means of an insulating mount 38. Each brush 39, 40 has a silver contact at each extremity. A conducting wire 41, only partially shown, connects the brush 39 to a connector 42 which may be pushed onto a spade terminal 43 on the bulb 1. The second terminal of the bulb filament is connected to the frame 3 through the bulb mounting. A spade terminal 45 is connected to the brush 40 by a second connector and a second conducting wire 44.

Referring now to FIG. 2, a rigid metal hoop 46 has V section ridges on its edges and its width is such that the two rollers 22 and 23 of each of six chassis can locate on the upper edge, while the lower rollers 24 can locate on the lower edge. The chassis thus mounted externally can move around the axis 47 of the hoop 46. The lower rollers can be adjusted to eliminate shake when the chassis move on their rollers around the hoops.

The hoop has stretched around its external face two groups 48 and 49 of three equispaced, square section wires. These wires are small enough to fit between the side links of the roller chains 50 (of which only one is shown in FIG. 2) to form "races" around which the chains can move. The wires 48, 49 are terminated by having their ends bent and passed through the two groups of holes 51 and 52, and are tied off on the inside of the hoop 46. Equality of lateral spacing of the wires is ensured by short dowels 53, spaced at intervals around the hoop 46. Holes 54 in the hoop 46 allow it to be fixed in the light housing 37 (see FIG. 4).

Two further hoops 55 and 56 are mounted inside the hoop 46 so that the hoop 55 protrudes above the upper edge of the hoop 46, and the hoop 56 protrudes below the lower edge of the hoop 46. The hoops 55 and 56 each have three inclined slots 57 pierced in them approximately equally spaced around the hoops. Two plain pins 58 in each hoop and one rotating spindle 59, 60 in respective slots of each hoop mount the hoops 55, 56 on the hoop 46. FIG. 3 shows in more detail the inside of the hoop 55, and the end of the spindle 59 which is toothed and engages an inclined rack 61 attached to the hoop 55.

The toothed spindles 59,60 are mounted on a pair of similar brackets 63,64. A second pair of brackets is attached to the hoop 46 diametrically opposite those shown in FIG. 2. Each pair meets (at 65 in FIG. 2) to form a bridge over the two groups of wires 48, 49 and provides a robust bearing hole 66 for mounting the light. The spindle 59 carries a toothed pulley wheel 67 which is connected by a toothed drive belt 68 to a toothed wheel 69. The wheel 69 is carried by a tubular spindle journalled on the spindle 60. The spindles 60 and 70 both protrude from the bracket 64, and are fitted, outside the housing, with knobs 71, 72 respectively. Rotation of the knobs 71,72 rotates the spindles 60,61 and, through the toothed ends 62 moves the hoops 56, 57 around the axis 47 of the hoop 46. During such movement, the hoops 56, 57 are maintained concentric with the main hoop 46 by a multiplicity of rollers 73 each set in slots cut at the same incline as the slots 57. The rollers 73 run on pin axles 74 so as to roll on the inside surface of the hoop 46. As the knob 71 or 72 is rotated the corresponding hoop 55, 56 revolves about the axis 47, and, because the slots 57 are inclined, also moves axially. When a number of lamp units 100 are mounted by their rollers 22, 23 and 24 on the hoop 46, each has a roller 31 engaging the upper edge of the hoop 55, and a roller 18 engaging the lower edge of the hoop 56. Thus, movement of the knob 72 varies the convergence angles of all the units in unison, through axial movement of the top hoop 55, thereby changing the patch range. Movement of the knob 71 varies the beam widths of all the units in unison, through axial movement of the bottom hoop 56, thereby changing the patch size. Variations to the patch range and patch size can be made regardless of the positions of the lamp units 100 around the hoop 46.

Preferably, six lamp units 100 are used, three being mounted on each semicircular arc of the hoop 46. The lamp units 100 are moved around the hoop 46 by means of six separate knobs, three being shown in FIG. 2 and three being similarly arranged on the brackets diametrically opposite those shown in FIG. 2. Three knobs 75 are fitted to the lower extremities of respective, vertical shafts 76, 77, 78 which are mounted in bearings in the brackets 63, 64 so as to be parallel to and equidistant from the axis 47. Each shaft 76, 77, 78 carries a sprocket 79 which engages a respective roller chain 35; (five chains and the mating sprockets have been omitted from FIG. 2 for clarity). Rotation of any of the six knobs 75, which are located outside the light housing, moves the respective roller chain along its race and adjusts the position of its associated lamp unit 100, thereby changing the configuration of the cluster.

FIGS. 4 and 5 are simplified views of the complete light. FIG. 4 shows schematically two of the six lamp units 100, the beams of which shine through clear, curved windows 80 in the underside of the toroidal housing 37. The toroidal housing 37 is made of a lightweight material and has a cross section which provides a streamlined flow of sterile air passed the housing, and prevents drips of condensation forming.

The complete light is supported by a half gymbal 81 through a pair of pivots 82 which engage the pivot holes 66. Electrical power is provided to the lamp unit through two wires 83 and 84 in respective limbs of the gymbal 81. The wires 83, 84 pass through the hollow bearings and are connected to respective conducting tracks 84 on the hoop 46, which is made of an insulating material. The brushes 39,40 (see FIG. 1) on each lamp unit make electrical contact with the silver plated tracks 84.

In order to aid the correct targeting of a multilamp light such as that described above it is helpful to provide a fine, intense, collimated beam of light along the axis 47 of the toroidal housing 37. For this purpose a streamline section tube 85 (FIG. 6) extends across the central hole of the toroidal housing, preferably along the axis of the bearing 82. The tube 85 has an aperture 86 on the underside, aligned with the axis 47 of the housing 37. A mirror 91, preferably dichroic coated, over the aperture 86 is set at 45° to this axis and to that of the tube 85. A bulb 88 preferably a halogen bulb is mounted inside the tube 85 at one end thereof with the axis of the filament coincident with the axis of the tube 85. A lens array 89 focuses the image of the filament into a thin pencil of light 90 which is reflected through the aperture 86 of the mirror 91. A spherical mirror 92 may be placed behind the bulb 88 to increase the beam intensity. A coloured filter 93 is mounted between the lens array 89 and the mirror 91 on the spindle 94 so that it can be moved into or out of the light beam as required, by turning the knob 95.

I claim:

1. A lamp unit comprising a mounting for a light source, a member defining an aperture, and a reflector positioned to reflect light from a light source mounted in said mounting, to generate a beam which is directed towards said aperture and converges at a point between said reflector and said aperture, said mounting and said reflector being movable one with respect to the other to move the point of convergence toward and away from said aperture.

2. A lamp unit according to claim 1, wherein said aperture-defining member is a ring defining a circular aperture.

3. A lamp unit according to claim 1, further comprising a frame supporting said mounting, said aperture-defining member and said reflector, said reflector being slidably mounted on a portion of said frame.

4. A lamp unit according to claim 1, further comprising a housing around said mounting, said aperture-defining member and said reflector, and means operable from outside said housing for moving said reflector and said mounting one with respect to the other.

5. A lamp unit according to claim 1, further comprising a dichroic coated heat filter in the path of said light beam.

6. A lamp unit according to claim 5, wherein said heat filter is downstream of said aperture-defining member.

7. A lamp unit according to claim 1, further comprising a converging lens in the path of said light beam downstream of said aperture-defining member.

8. A lamp unit according to claim 7, wherein said converging lens is a Fresnel lens.

9. A lamp unit according to claim 1, wherein said reflector is a concave ellipsoidal reflector.

10. A lamp unit according to claim 1, wherein said reflector is dichoric coated.

* * * * *